United States Patent [19]

Biesinger

[11] 4,259,855

[45] Apr. 7, 1981

[54] APPARATUS FOR THE CHEMICAL TREATMENT OF ARTICLES

[75] Inventor: Erwin Biesinger, Rottenburg, Fed. Rep. of Germany

[73] Assignee: Seco Maschinenbau GmbH & Co. KG, Rottenburg, Fed. Rep. of Germany

[21] Appl. No.: 70,308

[22] Filed: Aug. 27, 1979

[30] Foreign Application Priority Data

Sep. 12, 1978 [DE] Fed. Rep. of Germany ..... 2839558

[51] Int. Cl.[3] ..... C14C 1/00

[52] U.S. Cl. ..... 69/30

[58] Field of Search ..... 69/30, 31; 34/108, 109

[56] References Cited

U.S. PATENT DOCUMENTS

| | | | |
|---|---|---|---|
| 1,414,404 | 5/1922 | Glasel | 69/30 |
| 3,919,865 | 11/1975 | Glandfield | 69/30 |
| 4,077,466 | 3/1978 | Fleissner | 69/30 |

FOREIGN PATENT DOCUMENTS

| | | | |
|---|---|---|---|
| 273365 | 9/1970 | U.S.S.R. | 69/30 |

*Primary Examiner*—Patrick D. Lawson

*Attorney, Agent, or Firm*—Michael J. Striker

[57] ABSTRACT

A device for chemically treating leather and the like has a housing and a rotary drum. The housing has an opening opposite an open end of the drum. A double-walled door closes the opening and its interior communicates with a channel in the housing and with the interior of the drum, respectively.

5 Claims, 2 Drawing Figures

APPARATUS FOR THE CHEMICAL TREATMENT OF ARTICLES

BACKGROUND OF THE INVENTION

This invention relates to apparatus for the chemical treatment of articles, especially—but not exclusively—for the tanning and degreasing of skins and hides.

It is known to have washing machines and drycleaning machines which contain a rotatable drum in a housing. The housing has an opening opposite the open end of the drum and a door for closing the opening when the machine is in use. These machines are well suited for treating textiles, such as garments, but it has been found that they are not suitable for other applications, for example in the treating of hides and skins. These are two main reasons for this. One is that the door of the housing and the opening of the drum itself are kept as small as possible in the existing machines to prevent the escape of the textiles; in the case of bulky and relatively stiff hides and skins this is, of course, a hindrance. The other problem is that in the known machines it is difficult to admit gaseous treating media into the drum interior, which is a frequent requirement in other applications, e.g. in the treating of hides.

SUMMARY OF THE INVENTION

It is therefore an object of the invention to overcome the prior-art drawbacks.

A more particular object is to provide an improved apparatus of the kind under discussuion, which is suitable for the chemical treatment of a wide variety of materials, including hides and skins.

In keeping with these objects, and still others which will become apparent hereafter, one aspect of the invention resides, in an apparatus of the type under discussion, in a combination comprising a housing; a drum rotatable in the housing and having an open end; an opening in the housing coaxial and closely adjacent to the open end; a double-walled door for closing the opening; and means communicating the interior of the door with a channel formed in the housing and with the interior of the drum, respectively.

In this construction the double-walled door of the housing permits the introduction of treating gas or of air to evaporate chemical solvents, into the drum from the open front end of the same. The stream of gas enters directly through the open end, unhindered by the drum wall, so that optimum results are obtained. By having, according to one embodiment, the gas emerge from the door in the lower half of the door height, it is assured that the goods to be treated will always be reliably contacted with the gas, even though they drop under the influence of gravity into the lower drum half as the drum rotates. The danger of having most of the gas flow above the goods without doing any good, is thereby avoided.

Contact of the material moving in the drum, with the stationary housing door—and the resulting friction and retention of the material—can be avoided by installing on the inner side of the door a freely turnable disk which is coaxial with the open end of the drum and overlaps this open end. The disk must, of course, be provided with cut-outs at least in the region of the opening or openings through which gas exits from the interior of the door, so as not to preclude the free flow of the gas into the drum interior.

The novel features which are considered a characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
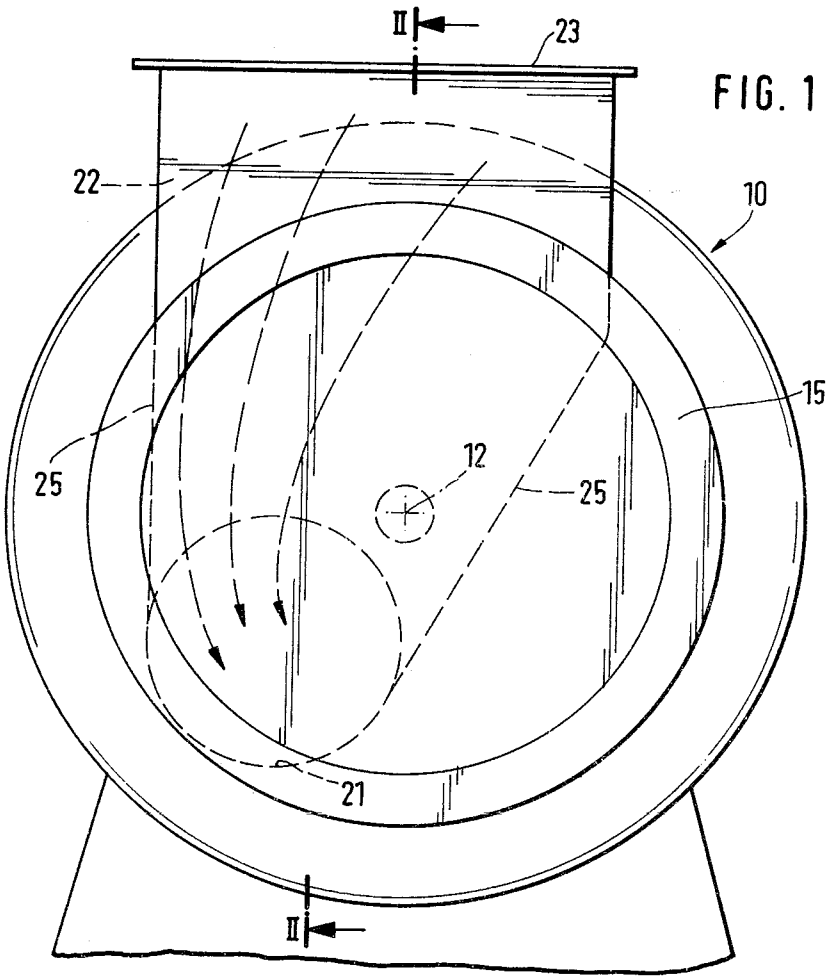
FIG. 1 is a diagrammatic end view of an apparatus embodying the invention.

The apparatus has a housing 10 which is basically cylindrical in shape and has an interior chamber 11. Mounted in the chamber 11, for rotation about a horizontal axis 12, is a drum 13 having the usual perforate drum wall (perforations shown in FIG. 2). The (not illustrated) rear end of the drum is mounted in cantilever fashion as is known per se from the art. A suitable drive is provided (also know per se) to rotate the drum about the axis 12. The front end of drum 13 has an opening 14 which is concentric to the drum wall and is almost equal in size to the drum cross-section.

The housing 10 has opposite the drum opening 14 its own door opening which is circular and closable by an equally circular door 15. The door can be swung between open and closed positions and locked in its closed position (not shown, since known per se) . In closed position an O-ring seal 16 sealingly engages the outer side of housing wall 17 in which the door opening is formed. The door opening is of a size at least substantially equal to that of the drum opening 14.

Figure 2:
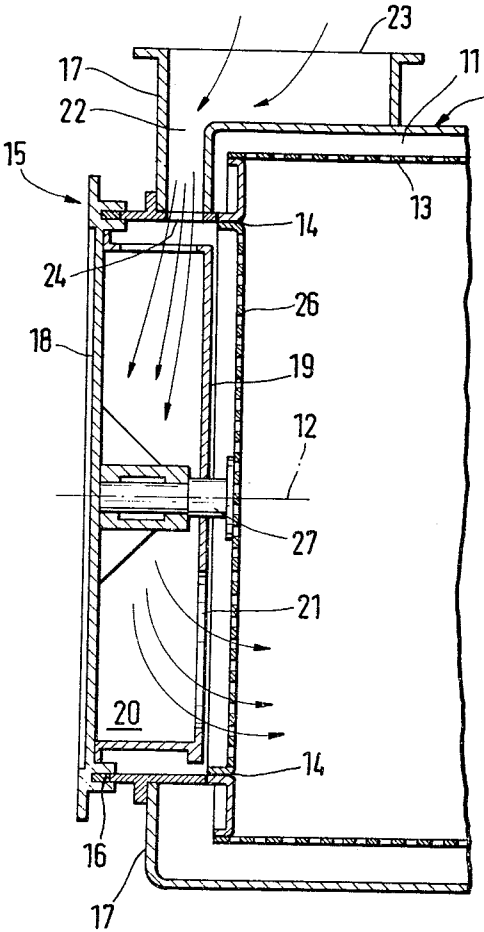
FIG. 2 is a partial section on line II—II of FIG. 1.

FIG. 2 shows that the door 15 is double-walled, i.e. that it has an outer wall 18 and an inner wall 19. These include between themselves a free space 20 which at its upper side is open in radially outward direction and serves as a gas supply channel. The lower half of the inner wall 19 is formed with at least one hole 21 which is shown to be circular but could have a different shape. The hole 21 will be seen in FIG. 1 to be located eccentrically with reference to the plane of symmetry of the housing 10. The direction of eccentricity depends upon the preferred direction of rotation of the drum 13; the hole 21 is located at that position where, when the drum rotates, the maximum amount of material being treated tends to accumulate.

The upper wall of housing 10 is also double-walled, to form a gas channel 22 which extends from an upper inlet 23 to an opening 24 in the vicinity of the door opening. The broken lines 25 in FIG. 1 indicate the outline of the gas channel which extends in the housing 10 and the door 15 to the hole 21 in the wall 19 of door 15. The arrows in FIGS. 1 and 2 indicate the flow of a treating gas which is blown (by a known per se blower) through the channel and into the drum 13.

Adjacent the inner side of wall 19, i.e. that side which faces inwardly of the drum when the door 15 is closed, there is mounted on apertured disk 26 which is freely turnable about the axis 12. The disk extends parallel to wall 19 and has a diameter sufficient to cover the entire drum opening 14; it is mounted on the door via a shaft 27. The presence of the disk, and its ability to freely rotate, prevents contact of the goods—e.g. hides—with the stationary wall 19 so that scraping and wear damage to the goods is avoided. The cut-outs in disk 26 allow the gas from hole 21 to enter the drum 13 without hindrance. This gas may be a gaseous chemical treating medium, but it may also be a stream of circulating air which serves to evaporate and later condense liquid treating agent after the treatment—e.g. tanning and degreasing of hides—is completed.

It will be understood that each of the elements described above, or two or more together, may also find a useful application in other types of tumbling apparatus differing from the types described above.

While the invention has been illustrated and described as embodied in a treating machine for hides and skins, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for chemical treatment of articles, particularly of hides, a combination comprising a housing; a drum rotatable in said housing and having an open end; an opening in said housing coaxial and closely adjacent to said open end; a double-walled door for closing said opening; a channel formed in said housing for communication with a source of flowing air; and means communicating the interior of said door with said channel formed in said housing and with the interior of said drum, respectively, so that air is admitted via said channel and door directly into the interior of said drum.

2. A combination as defined in claim 1, said housing including a door frame about said opening and said door having an outer and an inner wall; and wherein said means comprises at least one hole formed in said door in the area of said door frame and at least one other hole formed in said inner wall.

3. A combination as defined in claim 2, wherein said other hole is located centrally of said inner wall.

4. A combination as defined in claim 2, wherein said opening is of at least substantially equal size as said open end, said open end being at least substantially equal in size to the cross-sectional area of the drum; and wherein said opening is formed in a lower half of the door.

5. A combination as defined in claim 2; further comprising a disk freely turnably mounted on said inner wall at a side thereof which in operation faces said open end, said disk being coaxial to and closing said open end and having cut-outs at least in the region of said other opening.

* * * * *